US010457054B2

(12) United States Patent
Kawai

(10) Patent No.: US 10,457,054 B2
(45) Date of Patent: Oct. 29, 2019

(54) PREVENTING DETERIORATION IN AESTHETIC APPEARANCE OF A PRINTED RESULT WITHOUT REDUCTION OF PRINTING SPEED

(71) Applicant: BROTHER KOGYO KABUSHIKI KAISHA, Nagoya-shi, Aichi (JP)

(72) Inventor: Ryuji Kawai, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 0 days.

(21) Appl. No.: 16/140,675

(22) Filed: Sep. 25, 2018

(65) Prior Publication Data

US 2019/0092025 A1 Mar. 28, 2019

(30) Foreign Application Priority Data

Sep. 27, 2017 (JP) ..... 2017-186501

(51) Int. Cl.

| | |
|---|---|
| ***B41J 2/175*** | (2006.01) |
| ***B41J 29/393*** | (2006.01) |
| ***B41J 2/21*** | (2006.01) |
| ***B41J 2/045*** | (2006.01) |
| ***B41J 2/32*** | (2006.01) |

(52) U.S. Cl.

CPC ..... *B41J 2/175* (2013.01); *B41J 2/04595* (2013.01); *B41J 2/2132* (2013.01); *B41J 2/32* (2013.01); *B41J 29/393* (2013.01); *B41J 2029/3932* (2013.01)

(58) Field of Classification Search

CPC ... B41J 2/175; B41J 2/32; B41J 29/393; B41J 2/2132; B41J 2/04595; B41J 2029/3932

See application file for complete search history.

(56) References Cited

U.S. PATENT DOCUMENTS

| | | | | |
|---|---|---|---|---|
| 2003/0169309 | A1 | 9/2003 | Yokoyama | |
| 2011/0134177 | A1* | 6/2011 | Konno | B41J 2/2125 347/14 |
| 2015/0174930 | A1* | 6/2015 | Yamaguchi | B41J 13/0009 347/16 |
| 2015/0220824 | A1* | 8/2015 | Kikuta | G06K 15/1881 358/3.05 |

FOREIGN PATENT DOCUMENTS

| | | |
|---|---|---|
| JP | 2003-316558 A | 11/2003 |
| JP | 2010-228259 A | 10/2010 |

* cited by examiner

*Primary Examiner* — Henok D Legesse

(74) *Attorney, Agent, or Firm* — Scully, Scott, Murphy & Presser, PC

(57) ABSTRACT

The disclosure discloses a non-transitory computer-readable medium storing a printing processing program for executing steps. In a line specification step, it is determined whether or not an on-dot ratio or the number of on-dots is equal to or greater than a threshold value and at least one print lines equal to or greater than a threshold value is specified. In a labeling step, a plurality of dot groups is identified such that on-dots adjacent to each other form one dot group. In a dot group specification step, at least one first dot groups including the at least one print lines is specified. In a density reduction process step, a density at the time of print formation of the on-dots included in the first dot groups is made lower than a density at the time of print formation of the on-dots included in at least one second dot groups.

7 Claims, 15 Drawing Sheets

[FIG. 1]
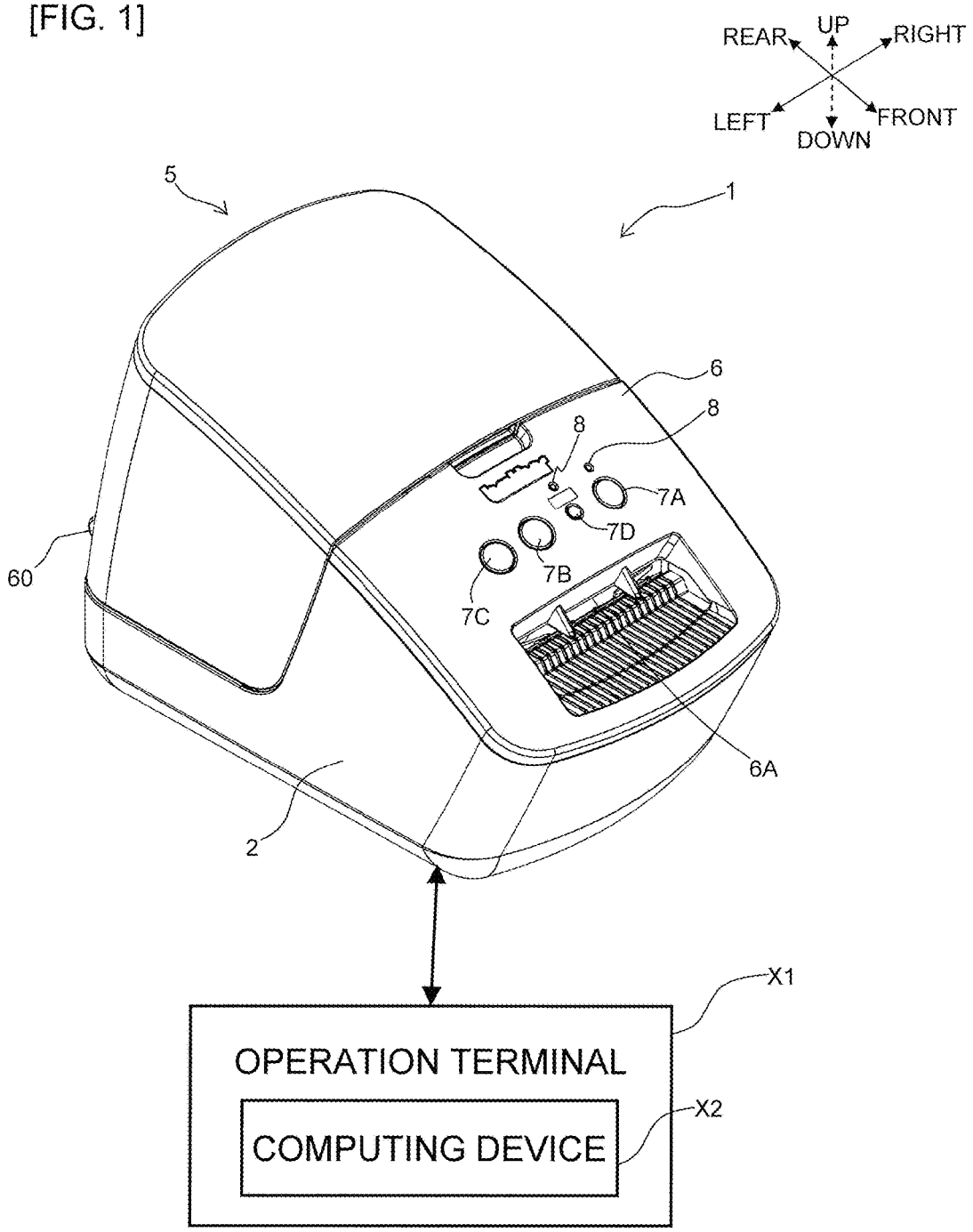

[FIG. 2]
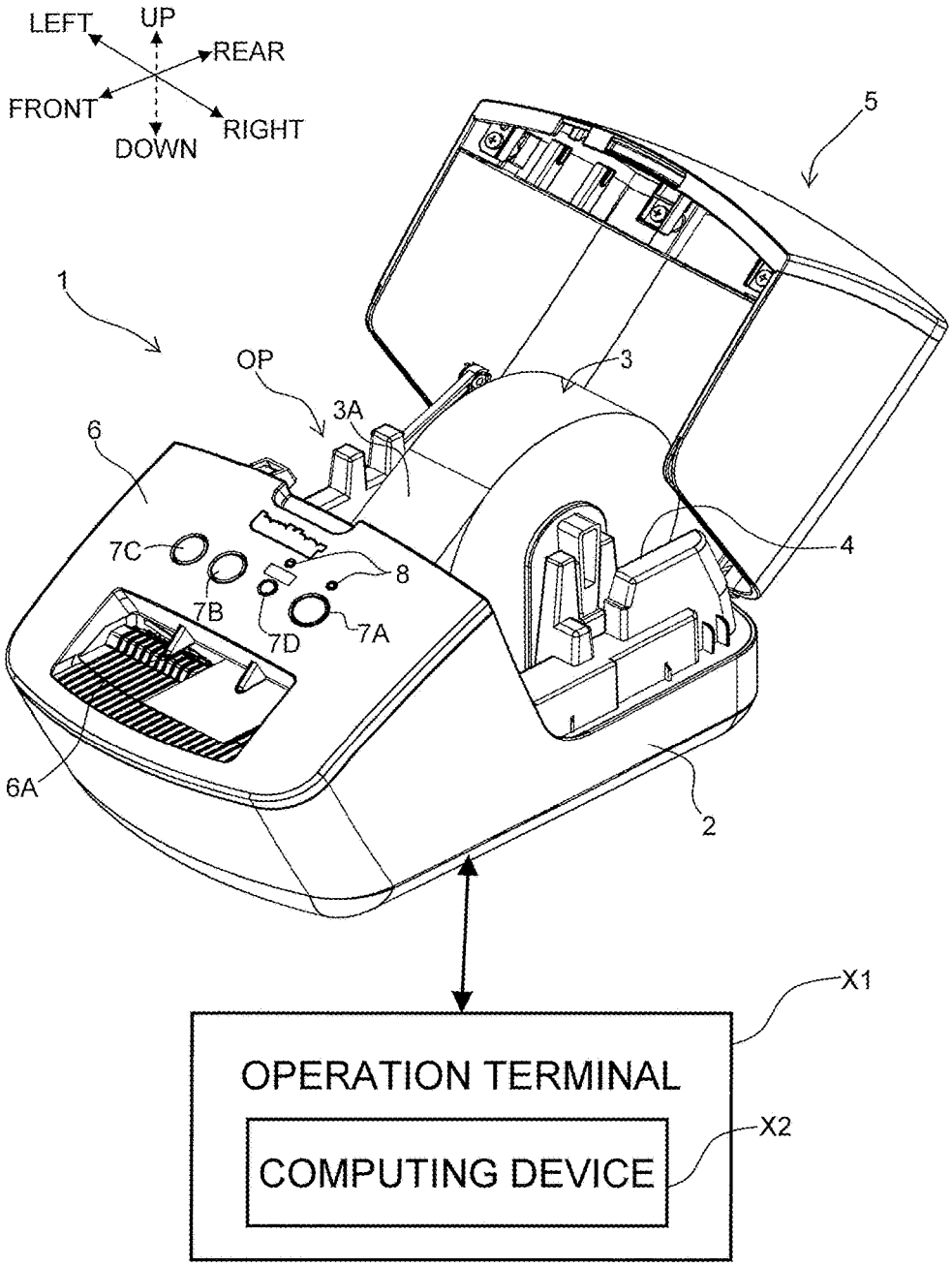

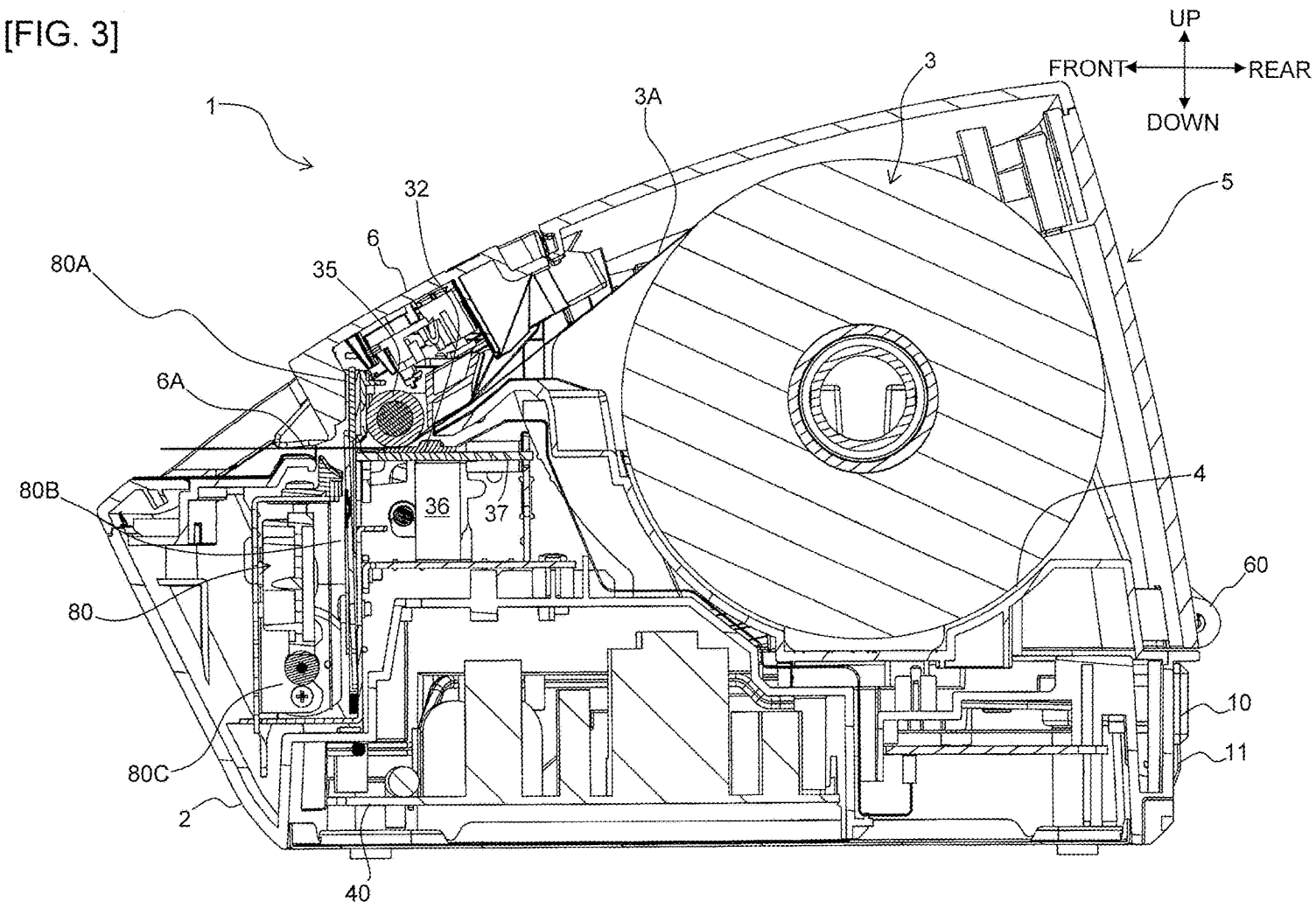
[FIG. 3]

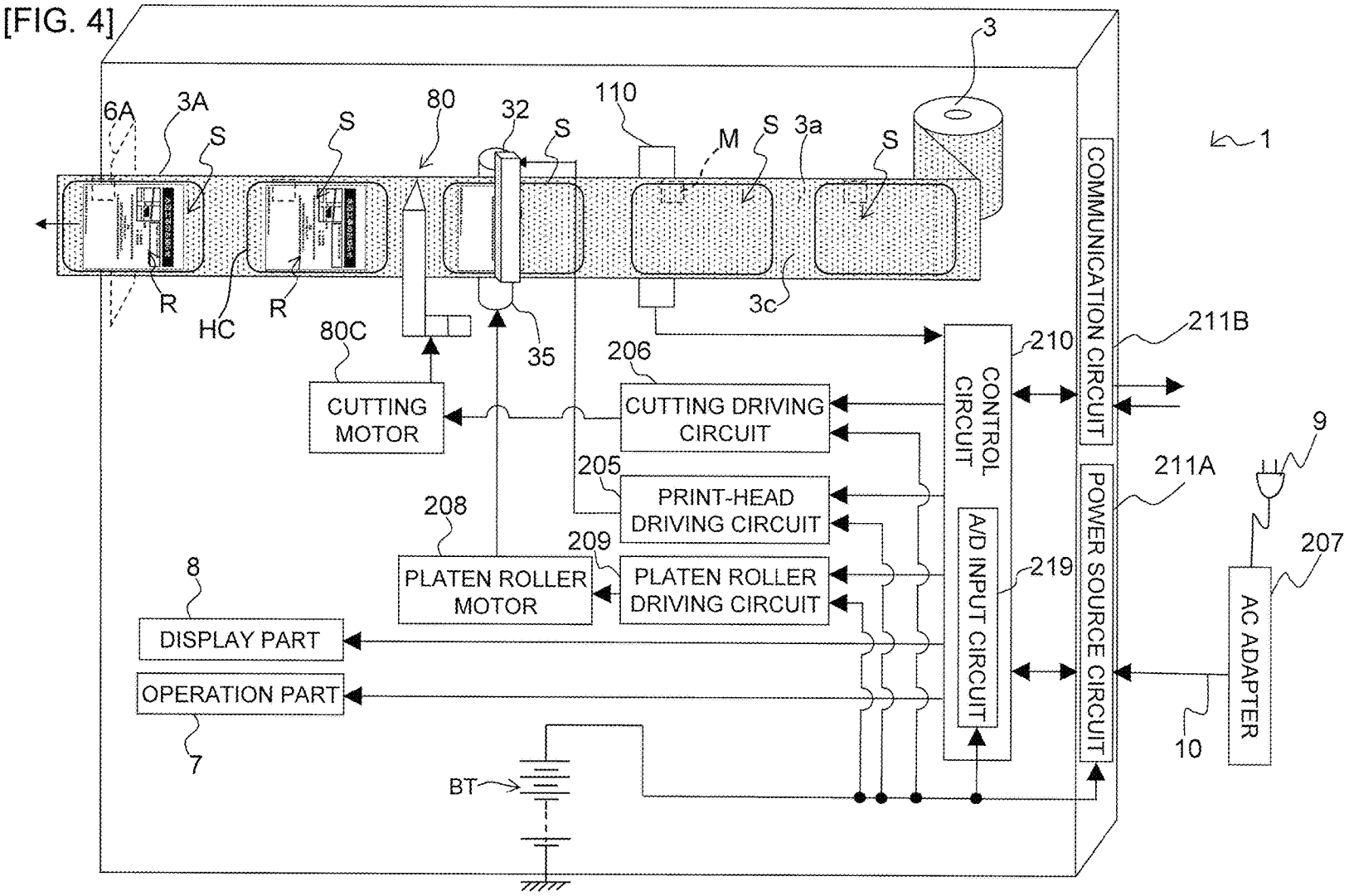
[FIG. 4]

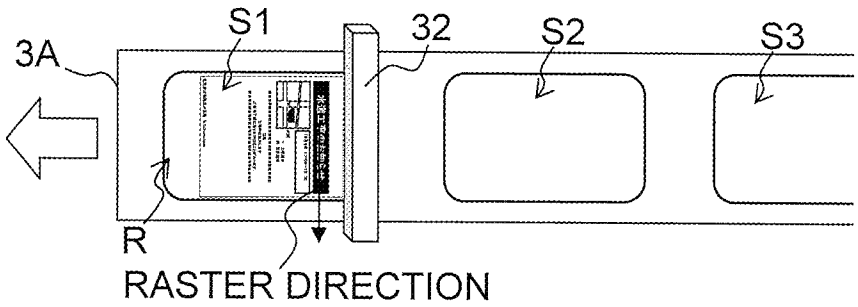
[FIG. 5A]
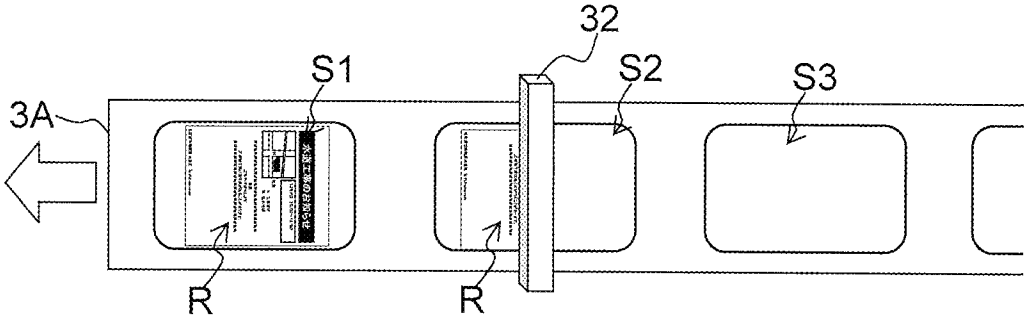
[FIG. 5B]

[FIG. 6A]
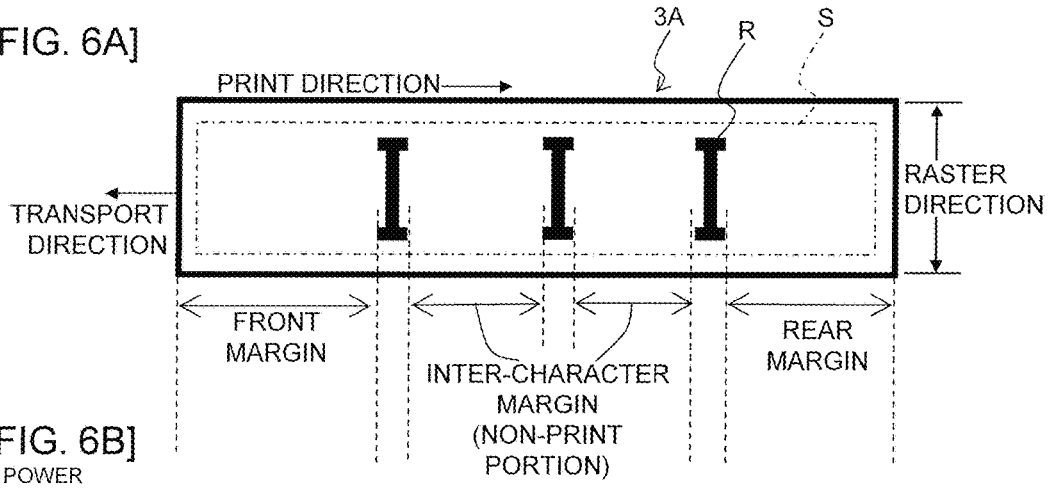
[FIG. 6B]
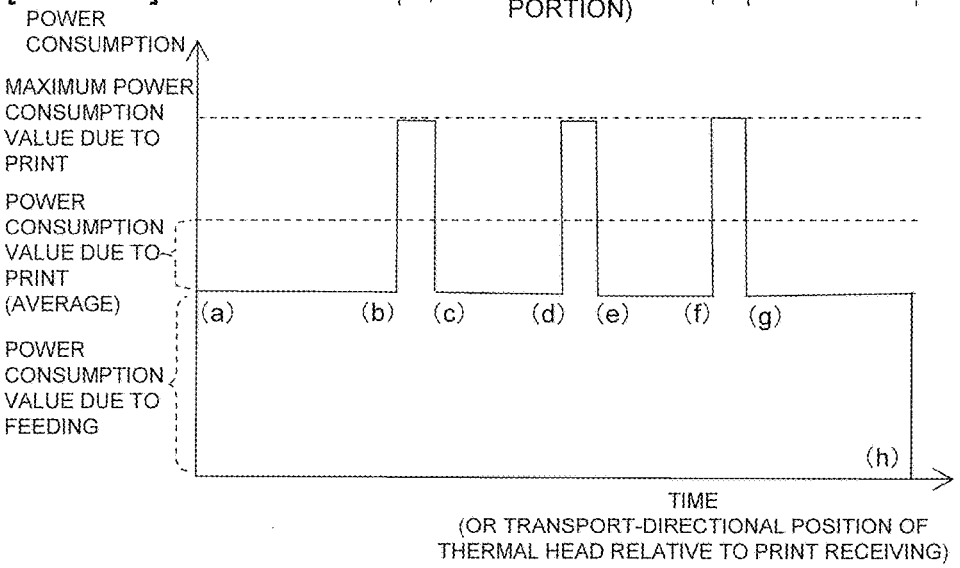

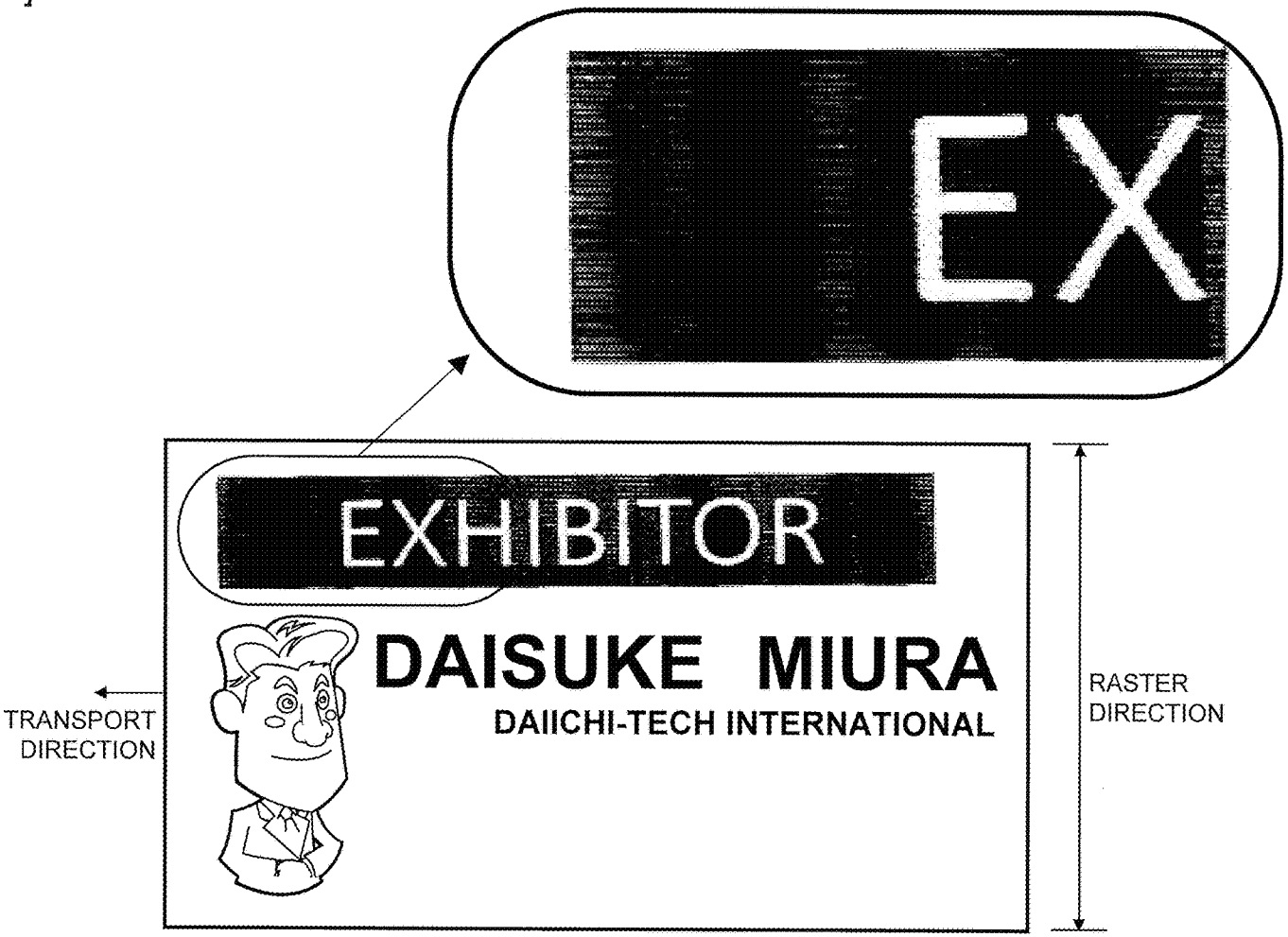
[FIG. 7]

[FIG. 8]
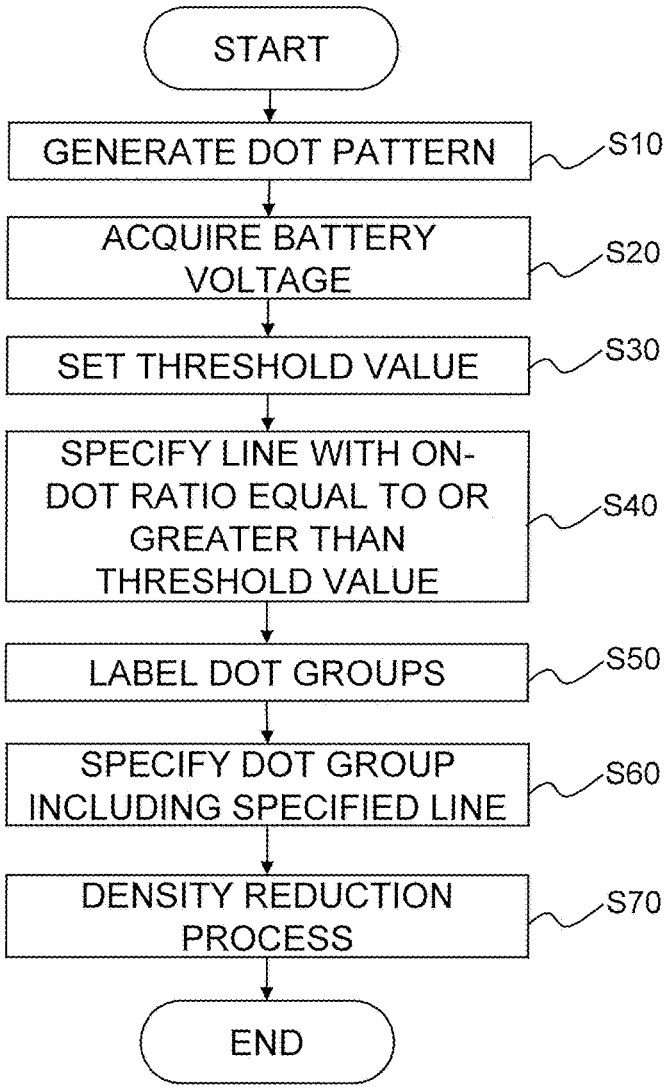

[FIG. 9A]
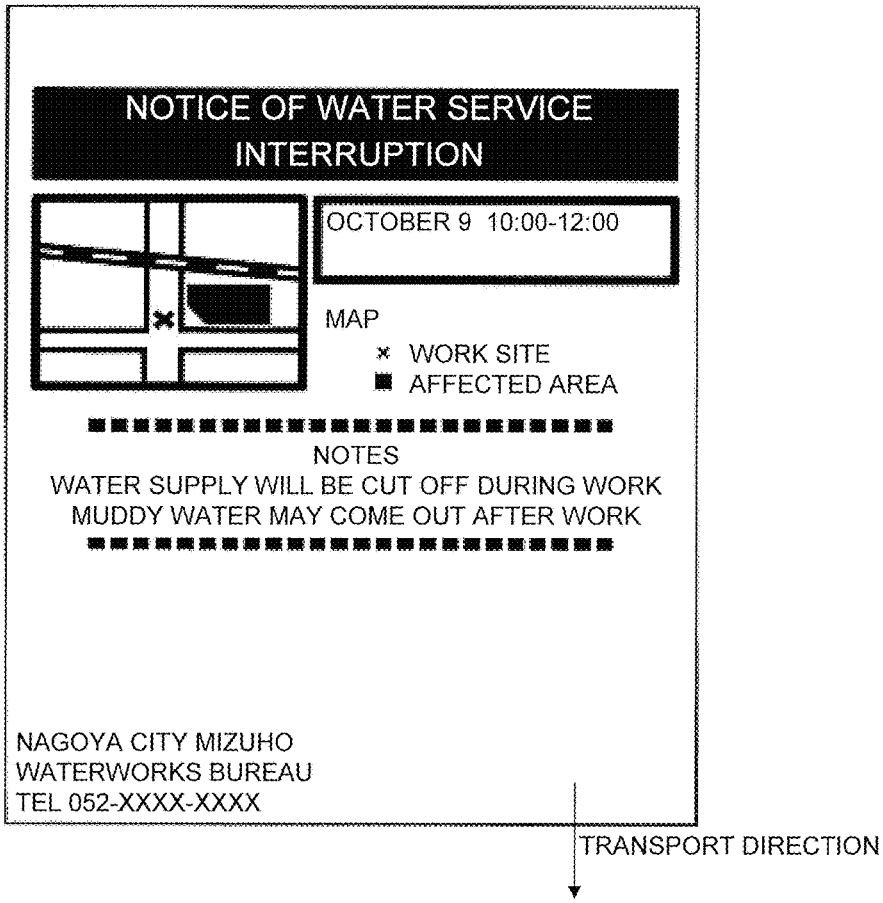

[FIG. 9B]
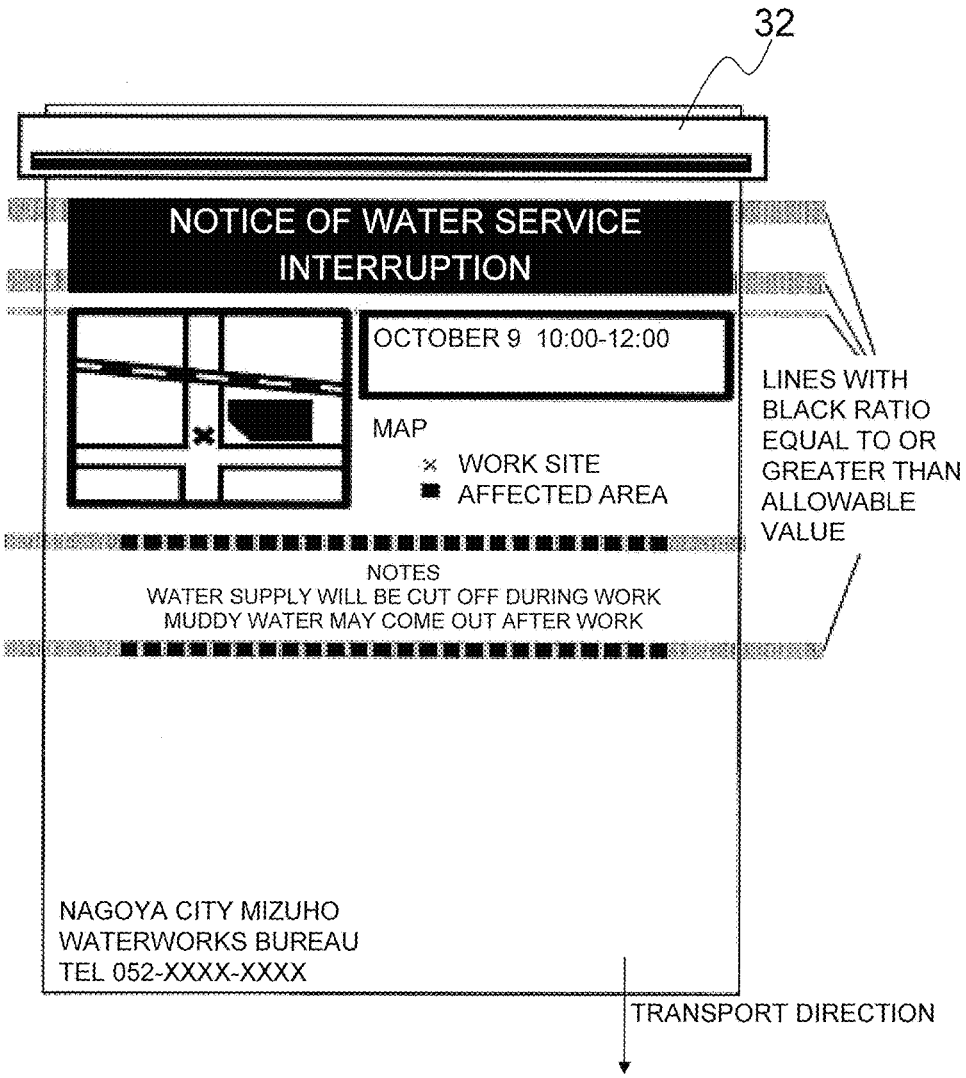

[FIG. 9C]
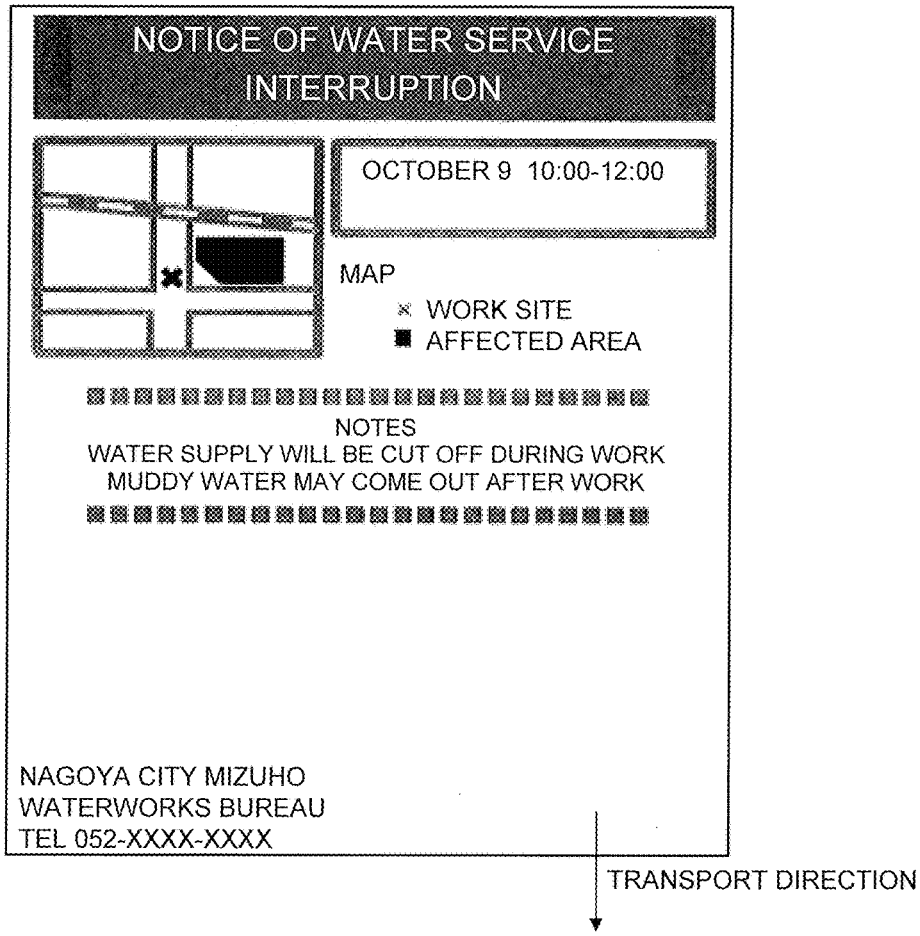

[FIG. 10]
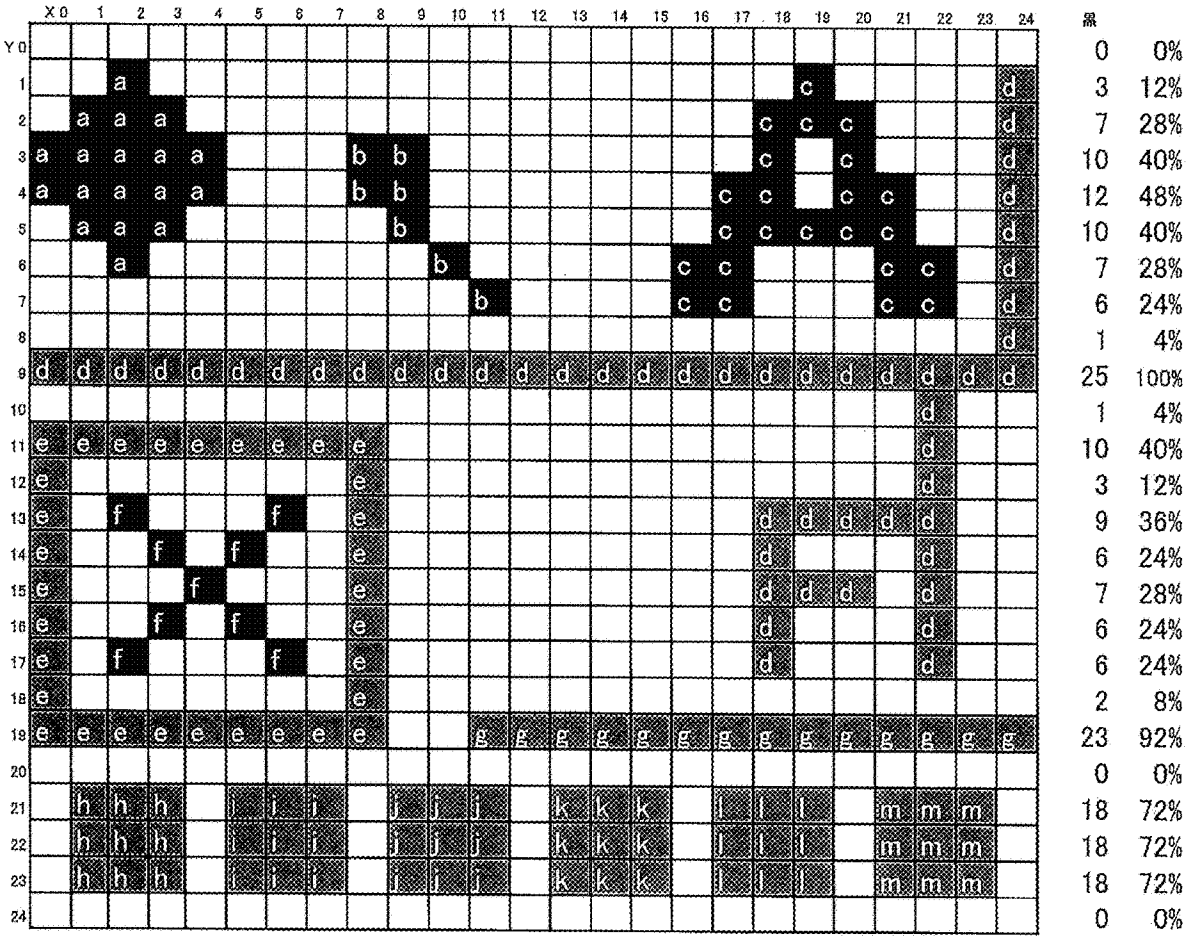

[FIG. 11A]
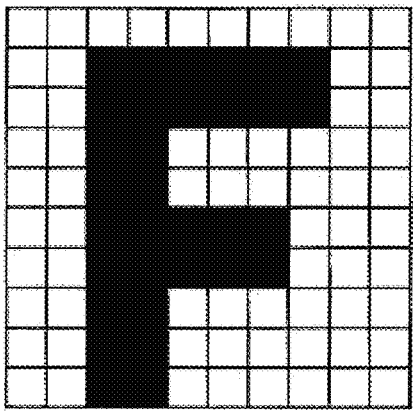
[FIG. 11B]
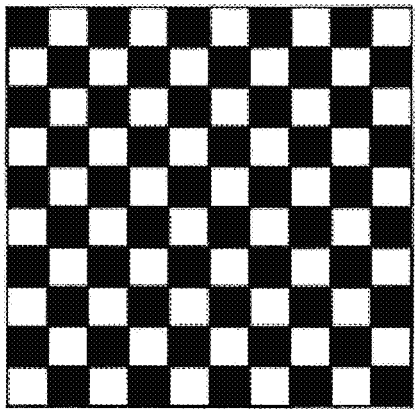
[FIG. 11C]
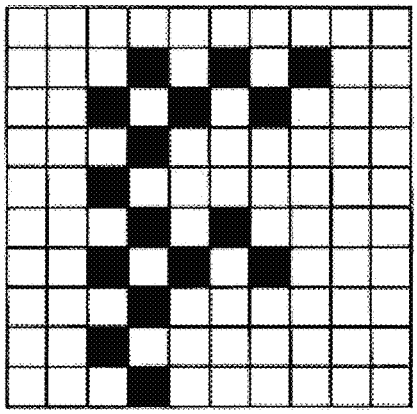

[FIG. 12A]
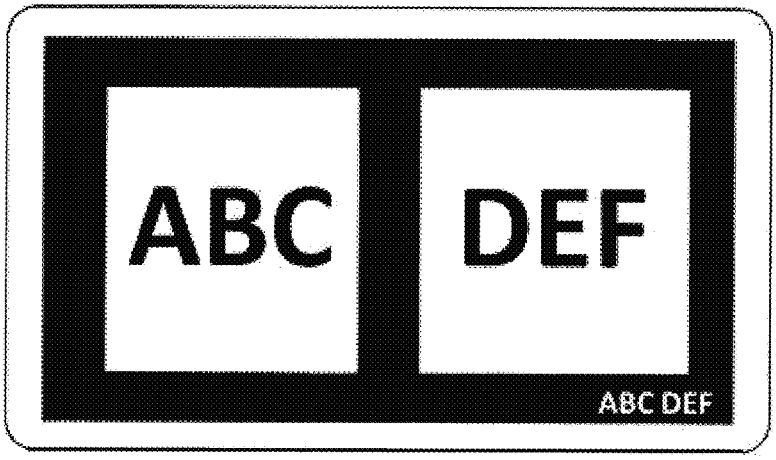
[FIG. 12B]
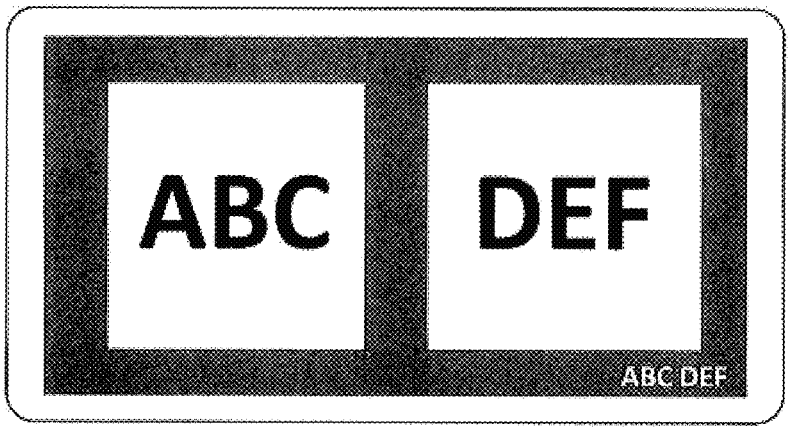

[FIG. 13]
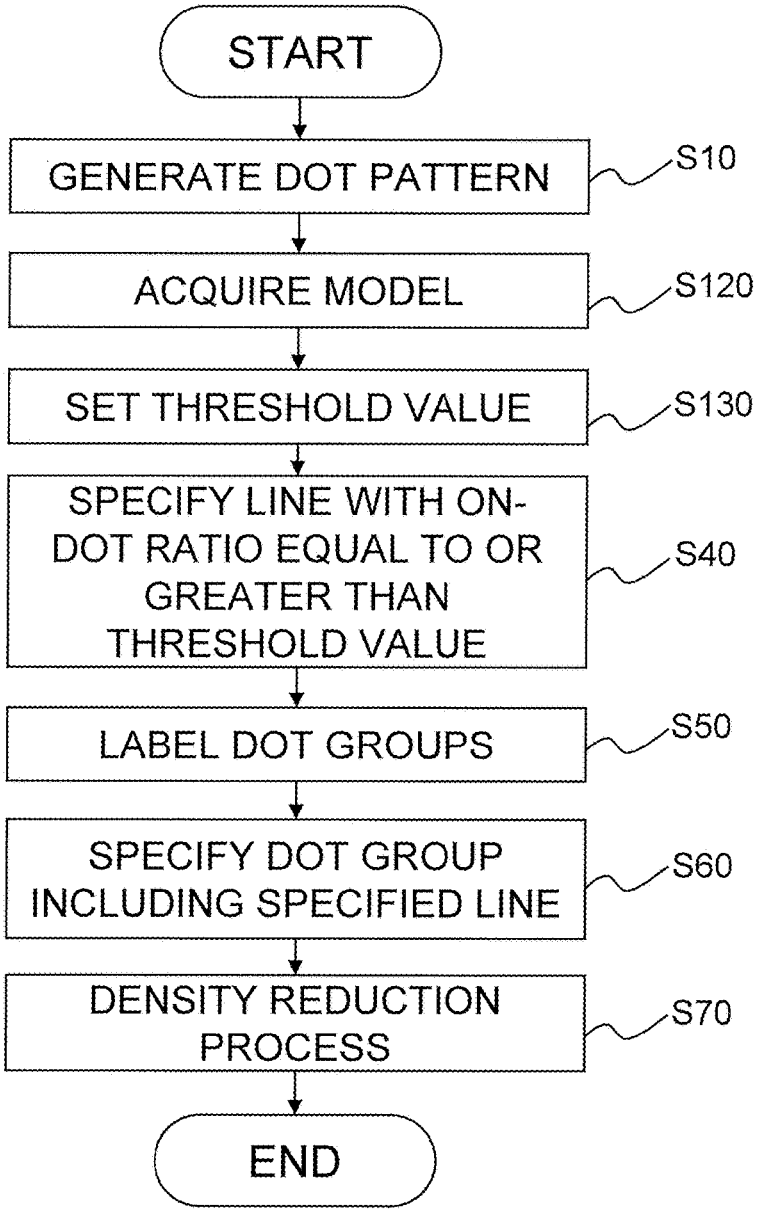

PREVENTING DETERIORATION IN AESTHETIC APPEARANCE OF A PRINTED RESULT WITHOUT REDUCTION OF PRINTING SPEED

CROSS-REFERENCE TO RELATED APPLICATION

The present application claims priority from Japanese Patent Application No. 2017-186501, which was filed on Sep. 27, 2017, the disclosure of which is incorporated herein by reference in its entirety.

BACKGROUND

Field

The present disclosure relates to a medium recording a printing processing program.

Description of the Related Art

For example, a thermal label printer printing labels by heat treatment is restricted in instantaneous maximum power consumption due to circumstances such as being driven by batteries. Therefore, in a thermal label printer, a restriction may be applied on the number of black-colored dots per line (the number of black dots in a raster direction). To alleviate such a restriction, for example, a printing processing program of a thermal label printer reducing a printing speed is already known. Specifically, according to this printing processing program, a process is executed for reducing a label feeding speed relative to a thermal head for a line with a large proportion of black-colored dots (also referred to as black proportion) and increasing the label feeding speed for a line with a small black proportion.

However, this results in a reduction in overall label printing speed. Furthermore, a print may become uneven due to occurrence of streaky noise (also referred to as banding) parallel to a main scanning direction (direction orthogonal to the raster direction. also referred to as a transport direction) associated with the change in the feeding speed, so that an aesthetic appearance of a label print result may be deteriorated.

SUMMARY

An object of the present disclosure is to provide a medium capable of preventing deterioration in aesthetic appearance of a printing result without lowering a printing speed even in a line with a large black proportion.

In order to achieve the above-described object, according to the aspect of the present application, there is provided a non-transitory computer-readable medium storing a printing processing program for executing steps on a computing device, the computing device included in an operating terminal for operating a printer comprising a thermal line head that includes a plurality of heat generation elements and is configured to form dots on respective print lines divided by print resolution on a fed print-receiving medium, and an energizing device configured to selectively control drive of the plurality of heat generation elements according to print data, the steps comprising a dot pattern generation step for generating a binarized dot pattern including on-dots to be printed and off dots not to be printed corresponding to the print data, a line specification step for determining whether or not an on-dot ratio represented by the number of on-dots/(the number of on-dots+the number of off-dots), or the number of on-dots, is equal to or greater than a threshold value for each print line in the binarized dot pattern generated in the dot pattern generation step, and for specifying at least one print lines equal to or greater than the threshold value, a labeling step for separately identifying a plurality of dot groups such that the on-dots adjacent to each other form one dot group in the binarized dot pattern generated in the dot pattern generation step, a dot group specification step for specifying at least one first dot groups including the at least one print lines specified in the line specification step among the plurality of groups identified in the labeling step, and a density reduction process step for executing a predetermined density reduction process of making a density at the time of print formation of the on-dots included in the first dot groups specified in the dot group specification step lower than a density at the time of print formation of the on-dots included in at least one second dot groups other than the first dot groups.

BRIEF DESCRIPTION OF THE DRAWINGS

FIG. 1 is a perspective view showing an appearance of a printer according to an embodiment of the present disclosure.

FIG. 2 is a perspective view showing the printer with an opening/closing cover opened.

FIG. 3 is a cross-sectional view showing the printer with a roll sheet holder mounted thereon.

FIG. 4 is a functional block diagram showing a control system of the printer.

FIG. 5A is an explanatory diagram showing a printing process when multiple print labels are produced.

FIG. 5B is an explanatory diagram showing a printing process when multiple print labels are produced.

FIG. 6A is an explanatory diagram showing a power consumption behavior during the printing process by the printer.

FIG. 6B is an explanatory diagram showing a power consumption behavior of the printing process by the printer.

FIG. 7 is an explanatory diagram showing an example of label print by the printer.

FIG. 8 is a flowchart showing processing procedures of a printing processing program according to the embodiment of the present disclosure.

FIG. 9A is an explanatory diagram showing an example of print data in a printing process.

FIG. 9B is an explanatory diagram showing a state in which print lines with a high black ratio are specified.

FIG. 9C is an explanatory diagram showing a state in which a density reduction process is performed for the specified print lines.

FIG. 10 is an explanatory diagram showing an example of a dot pattern of print data.

FIG. 11A is an explanatory diagram for explaining a masking process of the printing processing program according to the embodiment of the present disclosure.

FIG. 11B is an explanatory diagram for explaining a masking process of the printing processing program according to the embodiment of the present disclosure.

FIG. 11C is an explanatory diagram for explaining a masking process of the printing processing program according to the embodiment of the present disclosure.

FIG. 12A is an explanatory diagram for explaining another example of the density reduction process.

FIG. 12B is an explanatory diagram for explaining another example of the density reduction process.

FIG. 13 is a flowchart showing a processing procedure of a printing processing program according to a second modification example of the embodiment of the present disclosure.

DETAILED DESCRIPTION OF THE PREFERRED EMBODIMENTS

The present embodiment will now be described in detail with reference to the accompanying drawings. In this description and the drawings, constituent elements having substantially the same functions are denoted by the same reference numerals in principle. Redundant descriptions of these constituent elements will be omitted as appropriate.

<General Configuration of Printing System According to Embodiment of the Present Disclosure>

First, a general configuration of a printing system executing a printing processing program according to an embodiment of the present disclosure will be described with reference to FIGS. 1 and 2. FIGS. 1 and 2 are views showing the printing system executing the printing processing program according to the embodiment of the present disclosure.

As shown in FIG. 1, the printing system executing the printing processing program according to this embodiment has a printer 1 and an operation terminal X1. FIG. 1 shows a perspective view of the appearance of the printer 1 with an opening/closing cover 5 closed, and FIG. 2 shows a perspective view of the printer 1 having a roll sheet holder 3 mounted thereon with the opening/closing cover 5 opened.

The printer 1 has a thermal line head 32 (see FIG. 3 described later) including multiple heat generation elements forming dots on respective print lines divided by print resolution on a fed roll sheet 3A, and a print-head driving circuit (see FIG. 3 described later) selectively controlling drive of the plurality of heat generation elements according to print data.

The operation terminal X1 is a terminal for operating the printer 1 and causes a general-purpose or dedicated computer to execute a printing processing program to implement procedures according to an embodiment of the present disclosure. Consequently, the operation terminal X1 transmits print data to the printer 1 and causes the printer 1 to print the print data. For this purpose, the operation terminal X1 has a computing device X2.

The computing device X2 may have a CPU (Central Processing Unit), a recording medium such as an HDD (Hard Disk Drive), a ROM (Read Only Memory), and a RAM (Random Access Memory), a communication device connected to a network such as a LAN (Local Area Network) and the Internet, an input device such as a mouse and a keyboard, a drive for reading and writing on a magnetic disk such as flexible disk, various optical discs such as CD (Compact Disc), MO (Magneto Optical) disc, and DVD (Digital Versatile Disc), a removable recording medium such as a semiconductor memory, etc., and an output device such as a display device such as a monitor and an audio output device such as a speaker and a headphone. The computing device X2 executes a program recorded in the recording medium/the removable recording medium, or a program acquired through the network, to perform a series of procedures according to an embodiment of the present disclosure. In this case, the recording medium may be provided with, for example, a text memory area for storing print data including a text document (kuten codes) etc. produced by a user using various applications such as a word processor, a print buffer area for storing print dot patterns of multiple characters, symbols, etc., a parameter storage area for storing various pieces of computing data, etc.

The computing device X2 executes as a series of procedures a voltage acquisition procedure and a first threshold value setting procedure and/or a model acquisition procedure and a second threshold value setting procedure, a labeling procedure, a dot group specification procedure, and a density reduction processing procedure, with the printing processing program according to the embodiment of the present disclosure. To facilitate understanding of the embodiment of the present disclosure, an example of the printer 1 included in the printing system will first be described in detail, and these procedures will be described in detail later.

<General Structure of Printer>

A thermal printing type print label producing device (also referred to as a "thermal label printer") will be described as an example of the printer 1. It is noted that the printer 1 to be described is merely an example of a printer operated by executing the printing processing program according to the embodiment of the present disclosure, and the present disclosure is not limited thereto.

As shown in FIGS. 1 and 2, the printer 1 includes a housing 2 made of resin and constituting a portion of a contour of the printer 1. The housing 2 includes a roll sheet holder storage part 4 storing the roll sheet holder 3 around which a roll sheet 3A (corresponding to a print-receiving medium) of a desired width is wound. The upper side of the seat holder storage part 4 can be opened and closed by the opening/closing cover 5 made of transparent resin attached in a freely openable/closable manner via a pair of left and right hinge parts 60 on the rear side.

The roll sheet 3A includes an elongated sheet etc. having multiple pages in a length direction and is wound around the roll sheet holder 3. Particularly in this example, the roll sheet 3A is a so-called die-cut tape that has multiple label mounts S each preliminarily separated into a predetermined size, including a self-coloring thermal layer 3*c*, and continuously arranged away from each other in the length direction on one surface of a separation sheet 3*a* (see FIG. 4 described later).

The opening/closing cover 5 is pivotally supported by the housing 2 via the hinge parts 60 and is allowed to pivot so that an opening portion OP is opened and closed above the roll sheet holder storage part 4.

A front cover 6 on the front side of the opening/closing cover 5 is provided with a sheet discharging exit 6A discharging the roll sheet 3A subjected to a printing process (print process) (hereinafter also simply referred to as "printed"). On a front surface portion on the upper side of the sheet discharging exit 6A, a total of four buttons are substantially horizontally arranged as a power button 7A, a cut button 7B pressed down for driving the cutter unit 80 (see FIG. 3 described later) disposed inside the sheet discharging exit 6A to cut the roll sheet 3A to generate a print label (not shown), a feed button 7C for discharging the roll sheet 3*a* in the transport direction while being pressed, and another control button 7D (hereinafter, collectively simply referred to as an "operation part 7"). Additionally, for example, display parts 8 composed of LEDs are respectively disposed near the power button 7A and the control button 7D on the front cover 6.

A rear surface portion of the housing 2 is provided with an inlet 10 for connecting a power cord 9 (see FIG. 4 described later) from an AC adapter 207 (see FIG. 4 described later) connected to an external power source device, and a USB connector 11 is provided alongside thereof for connecting a computer etc. serving as the operation terminal X1. Communication with the operation terminal X1 may have any form as long as print data can be transmitted and received through wired communication (including direct insertion of a memory card etc.) or wireless communication other than the USB connector 11.

<Details of Roll Sheet Holder Storage Part>

A bottom surface portion of the roll sheet holder storage part 4 is provided with multiple sheet determination sensors (not shown) including, for example, push-type microswitches for determining the type, material, roll sheet width, etc. of the roll sheet 3A. These sheet determination sensors are composed of known mechanical switches including plungers and microswitches, and the on/off signals thereof are used for detecting the type, material, roll sheet width, etc. of the roll sheet 3A mounted on the roll sheet holder 3.

<Internal Equipment Such as Thermal Line Head and Cutter Unit>

FIG. 3 is a side sectional view showing a state in which the roll sheet holder is mounted on the printer.

As shown in FIG. 3, a platen roller 35 (corresponding to a feeder) is rotatably supported on the far side in the roll sheet transport direction of the opening OP. The thermal line head 32 (corresponding to a printing head) is fixed to an upper surface of a head support member 37 urged upward by a pressing spring 36.

A cutter unit 80 is disposed downstream of the platen roller 35 and the thermal line head 32 in the transport direction of the roll sheet 3A (on the left side in FIG. 3). As shown in FIG. 3, the cutter unit 80 has a fixed blade 80A and a movable blade 80B. In the case that the cut button 7B described above is pressed, the movable blade 80B is reciprocated in the up-down direction by a cutting motor 80C including a DC motor etc. As a result, after print by the thermal line head 32, the roll sheet 3A is cut to a desired length by the fixed blade 80A and the movable blade 80B so that a print label is generated and discharged from the sheet discharging exit 6A.

On the other hand, the lower side of the roll sheet holder storage part 4 is provided with a control board (including a power source board etc.) 40, a battery storage part (not shown) storing a battery BT described later, etc. The control board 40 is disposed with a control circuit 210 (see FIG. 4 described later) driving and controlling mechanism parts such as the thermal line head 32 according to a command from the external operation terminal X1 etc. and is electrically connected to the sheet determination sensors. For example, the control board 40 is disposed with a power source circuit 211A, a communication circuit 211B (see FIG. 4 described later), etc.

<Control System of Printer>

A control system of the printer 1 will be described with reference to FIG. 4. FIG. 4 is a functional block diagram showing a control system of the printer.

In FIG. 4, the printer 1 is provided with the platen roller 35 feeding and sending out the roll sheet 3A to the sheet discharging exit 6A, a platen roller driving circuit 209 controlling a platen roller motor 208 (corresponding to the drive device) driving the platen roller 35, a print-head driving circuit 205 (corresponding to an energizing device) selectively performing energization control of the multiple heat generation elements of the thermal line head 32, a cutting driving circuit 206 controlling the cutting motor 80C driving the cutter unit 80, and a control circuit 210 for controlling the overall operation of the printer 1 via the print-head driving circuit 205, the platen roller driving circuit 209, the cutting driving circuit 206, etc.

The control circuit 210 is a so-called microcomputer, including a CPU, a ROM, a RAM, etc., and executes a signal process according to a program (application) stored in the ROM in advance while using a temporary storage function of the RAM. The control circuit 210 is connected to the display part 8, the operation part 7, and the communication circuit 211B. The control circuit 210 is connected to an appropriate communication line via the communication circuit 211B and thereby can exchange information with the operation terminal X1, a route server, another terminal, a general-purpose computer, an information server, etc. connected to this communication line.

The RAM is provided with, for example, the text memory area, the print buffer area, the parameter storage area, etc. The text memory area stores print data transmitted from the operation terminal X1. The print buffer area stores print dot patterns of multiple characters, symbols, etc. as dot pattern data (print data), and the thermal line head 23 performs a dot print (printing process) in accordance with the dot pattern data stored in the printing buffer. The parameter storage area stores various pieces of computing data.

The control circuit 210 is connected to the power source circuit 211A. The power source circuit 211A is connected to the AC adapter 207 connected to the external power source device and executes power-on/off processes of the printing device 1. Additionally, the control circuit 210 is provided with an A/D input circuit 219 connected to the battery BT (e.g., a lithium ion rechargeable battery) stored in the battery storage part for measuring (detecting) an output voltage value of the battery BT. As a result, the platen roller driving circuit 209, the print-head driving circuit 205, and the cutting drive circuit 206 can be supplied with electricity selectively from the external power source via the AC adapter 207 or from the battery BT.

In this example, in the case that connection to the external power source is made through the power cord 9 and the AC adapter 207 while the battery BT is stored in the battery storage part, the power supply from the external power source is automatically selected by a known method, and in the case that the connection to the external power source is canceled (e.g., the power cord 9 and the AC adapter 207 are unplugged), the power supply from the battery BT is automatically performed by a known method.

On the other hand, as shown in FIG. 4, the roll sheet 3A wound around the roll sheet holder 3 has a print area in which a print R is formed by the thermal line head 32, on the side of the thermal layer 3*c* of each of the label mounts S as described above. On the side of the thermal layer 3*c* of each of the label mounts S, a substantially rectangular half-cut line HC is formed for peeling off each of the label mounts S after print formation from the separation sheet 3*a*. Therefore, a desired print R based on print data is printed on the label mount S surrounded by the half-cut line HC. After printing, the label mount S is peeled from the separation sheet 3*a* via the half-cut line HC and is bonded to an object by an adhesive layer on a back surface of the label mount S.

In this example, multiple marks M corresponding to the respective label mounts S are formed on a surface (on the side opposite to the thermal layer 3*c*) of the separation sheet 3*a*. These marks M are detected by an optical sensor 110, and this detection result is used for positioning at the time of feeding of the label mounts S. In this embodiment, the platen roller motor 208 may perform printing onto multiple pages of the label mounts S without stopping (non-stop printing) under the control of a CPU of the control circuit 210 via the platen roller driving circuit 209 during the printing. Instead of the marks M, edges at the half-cut lines HC constituting end surfaces of the label mounts S may be detected. The roll sheet 3A having the print R formed thereon as described above is cut by the cutter unit 80 through operation of the cut button 7B as described above, and a print label is generated.

<Energization Control of Thermal Line Head>

The energization control of the thermal line head 32 by the print-head driving circuit 205 will be described in detail. The thermal line head 32 includes the multiple heat generation elements (not shown) arranged in a direction orthogonal to the transport direction. The multiple heat generation elements form dots corresponding to the print data on the print lines of the roll sheet 3A and thereby form the print R.

Specifically, the CPU of the control circuit 210 generates the print data for forming dots with the heat generation elements from, for example, character string information acquired through an operation of an operator (user) via the operation part 7. In other words, the CPU generates print data (image data including data based on dots) to be printed on the basis of an input character string and the dot pattern stored in a CG-ROM (not shown) in the ROM and divides the print data into lines printed by the heat generation elements arrayed on the thermal line head 32. For example, in the case that the print resolution is set to 360 dpi, line print data divided into 360 lines per inch is generated. In the embodiment of the present disclosure, the printing processing program is executed by the operation terminal X1, and the print data is generated. Therefore, the control circuit 210 acquires the print data via the communication circuit 211B and generates the line print data.

The print-head driving circuit 205 supplies a drive signal to the thermal line head 32 on the basis of the line print data from the CPU and controls a drive form of the thermal line head 32. Therefore, the print-head driving circuit 205 writes the line print data in a data register associated with each of the heat generation elements and then controls the time and cycle of energization of each of the heat generation elements based on a strobe signal, thereby performing on/off-control of the heat generating form of the heat generation elements for each line of the line head 32. In the following description, "on-dot" refers to the energized state of the heat generation element, and "off-dot" refers to the non-energized state of the heat generation element.

Description will then be made of how dots are formed on each print line of the roll sheet 3A by energizing the thermal line head 32. The print line is a line having a row of dots formed in the width direction of the roll sheet 3A by energizing a row of the heat generation elements in one printing cycle and exists at each interval acquired by dividing a unit length in the transport direction of the roll sheet 3A by the resolution. The one printing cycle is a time required for forming a row of dots in the width direction of the roll sheet 3A (hereinafter also referred to as "raster direction"). The length of one print cycle varies depending on the resolution and the feeding speed of the tape 103 etc. For example, one printing cycle during printing at 360 dpi and 40 mm/s is the time (e.g., about 1.8 ms) required for passing between print lines (e.g., about 0.07 mm) of 360 dpi at 40 mm/s.

Therefore, when one row of dots is formed in the width direction of the roll sheet 3A, the line print data for one print line generated by the CPU is transferred to the thermal line head 32, and the corresponding heat generation elements are energized based on the transferred line print data for one print line. The line print data for one print line is print data for forming one row of dots in the width direction of the roll sheet 3A by energizing one row of heat generation elements in one printing cycle. Therefore, the heat generation elements energized based on the line print data for one print line generates heat to a color developing temperature required for developing color of the thermal layer 3*c*. As a result, a portion of the thermal layer 3*c* brought into contact with the thermal line head 32 develops color due to heating of the heat generation elements, so that dots corresponding to one print line are formed on the roll sheet 3A. While the roll sheet 3A is fed at a predetermined feeding speed defined in advance, the heating and coloring process is repeatedly executed by one print line at a time. A large number of heat generation elements arranged in the thermal line head 32 are selectively and intermittently energized each time based on the print data for each print line transferred from the CPU 111. Consequently, the roll sheet 3A has a user's desired dot image (text characters etc.) formed as the print R in accordance with the user's operation through the operation part 7 described above.

As described above, as the feeding of the roll sheet 3A causes the print lines of the roll sheet 3A to sequentially pass through the position of the heat generation elements, an energization form of the heat generation elements is sequentially switched for each piece of the line print data. As a result, the thermal line head 32 can perform printing at a printing cycle (in other words, printing speed) matched to the feeding speed of the roll sheet 3A.

When the print of the dot pattern data is completed, the feeding of the roll sheet 3A is stopped and the cutting motor 80C is driven via the cutting driving circuit 206 to cause the cutter unit 80 to cut the roll sheet 3A, so that a print label is generated.

<Print Parameters>

In the printer 1 of this embodiment, dots are formed on the print lines by the heat generation elements of the thermal line head 32 to print a desired image. Print parameters (e.g., printing speed, and energization time of the heat generation elements) used at the time of dot formation are calculated by the CPU of the control circuit 210.

As described above, the printer 1 can operate in both the energization state using the battery BT stored in the battery storage part (a first energization state) and the energization state using the external power source via the AC adapter 207 (a second energization state). The print parameters may have significantly different values between the first energization state using the battery BT and the second energization state using the external power source. FIGS. 5A and 5B are explanatory diagrams showing a printing process by the printer 1, and explanatory diagrams showing a label producing behavior when multiple print labels are produced. FIGS. 5A and 5B show the case that the same print objects (prints R) are continuously formed on the multiple label mounts S of the roll sheet 3A. Therefore, in this case, on the roll sheet 3A fed in the length direction that is orthogonal to the raster direction that is the width direction (see white arrows), the thermal line head 32 forms the print R on a first label mount S1 (i.e., a first page. the same applies hereinafter) as shown in FIG. 5A. Subsequently, as shown in FIG. 5B, the same prints R are also formed on a second label mount S2 (second page), a third label mount S3 (third page), etc.

<Black Proportion and Power Consumption and Banding>

Description will be made of an example of variation behavior of power consumption in the case that the print R of text characters "III" having a relatively small print coverage is formed to produce the print label L with reference to FIGS. 6A and 6B. FIGS. 6A and 6B is an explanatory diagram showing a printing process by the printer.

As shown in FIGS. 6A and 6B, during a front margin (section (a)-(b) in FIG. 6B), an inter-character margin between first and second alphabets "I" and "I" (section (c)-(d) in FIG. 6B), an inter-character margin between second and third alphabets "I" and "I" (section (e)-(f) in FIG. 6B), and a rear margin (section (g)-(h) in FIG. 6B), the power consumption occurs only due to the feeding.

During the first alphabet "I" (section (b)-(c) in FIG. 6B), the second alphabet "I" (section (d)-(e) in FIG. 6B), and the third alphabet "I" (section (f)-(g) in FIG. 6B), the power consumption occurs due to print.

As shown in FIG. 6, the alphabet "I" has a relatively large proportion of blackening in the raster direction. Therefore, in the thermal line head 32, a proportion of on-dots during formation of one print line (i.e., a black proportion. corresponding to a print coverage in an interval obtained by dividing the unit length in the transport direction by the resolution) becomes higher, and the power consumption during print of the alphabet "I" rapidly increases relative to an average value of power consumption during the other prints. Such a rapid increase in power consumption leads to a reduction in drive time in the first energization state using the battery BT. Even in the second energization state using the external power source, an instantaneous maximum power consumption may exceed an upper limit of the allowable amount. Correspondingly, limitations may be applied according to modes etc. in the printer 1 to reduce a print speed (in other words, a feeding speed, a printing speed) (for prevention of an overcurrent value in the case that the printer is driven by a battery) when a proportion of on-dots per print line reaches a certain degree or more. This is a technique of reducing the feeding speed (i.e., the printing speed) to suppress the instantaneous maximum power consumption during print of a print line having a high proportion of on-dots (such a line will hereinafter be referred to as an "all black line (a line having black pixels at a certain proportion or more)" as appropriate). In this case, for example, in a "speed priority mode", printing may be performed such that the feeding speed is reduced during print of a print line having a high proportion of on-dots as described above while the feeding speed is not reduced during print of the other lines, and in a "quality priority mode", printing may be performed such that the feeding speed is reduced over the entire range of the print R.

In the case that the feeding speed is reduced as described above in the quality priority mode, only the printing time becomes longer, while the printing quality is ensured. On the other hand, in the speed priority mode, the length of the printing time can be suppressed to a certain extent; however, due to repetition of a reduction in print speed in a print line having a high proportion of on-dots and an increase in print speed after such a print line as described above, "banding" may occur as unevenness of density in the transport direction as shown in FIG. 7, resulting in unevenness of print and deteriorating the aesthetic appearance of a print result.

Therefore, in the printing processing program according to the embodiment of the present disclosure, printing is thinned only in the solid black area associated with a heavy electric load to eliminate the need to reduce the printing speed, so that the printing can be performed at uniform speed over the entire print R. Therefore, such unevenness of density (unevenness of print) can be suppressed to maintain the printing speed while maintaining the aesthetic appearance of the print result. A main part of this embodiment for this purpose is a printing processing program causing the computing device X2 included in the operating terminal X1 to execute various procedures for generating print data in the basic configuration described above. The details will hereinafter be described in order.

<Printing Process of Printing Processing Program According to Embodiment of Present Disclosure>

A printing process of the printing processing program according to an embodiment of the present disclosure will be described with reference to FIGS. 8 to 11C. FIG. 8 is a flowchart showing the printing process of the printing processing program according to the embodiment of the present disclosure. FIGS. 9A to 9C and FIGS. 10 to 12B are explanatory diagrams for explaining the printing process of the printing processing program according to the embodiment of the present disclosure.

As shown in FIG. 8, the computing device X2 executes as a series of procedures a dot pattern generation procedure S10, a battery voltage acquisition procedure S20, a threshold value setting procedure S30, a line specification procedure S40, a labeling procedure S50, a dot group specification procedure S60, and a density reduction processing procedure S70, with the printing processing program according to the embodiment of the present disclosure.

In the dot pattern generation procedure S10, a binarized dot pattern including on-dots to be printed and off-dots not to be printed corresponding to print data is generated by the computing device X2 of the operation terminal X1. FIG. 9A shows an example of print data of a print label, and FIG. 10 shows an example of a binarized dot pattern obtained by simplifying a print area as a binary image of X25/Y25 size. As shown in FIG. 10, the print data shown in FIG. 9A is represented as dots on the print lines divided by print resolution. In FIG. 10, black dots and gray dots (described later) are on-dots, and white dots are off-dots. After execution of the dot pattern generation procedure S10, the battery voltage acquisition procedure S20 is executed.

In the battery voltage acquisition procedure S20, the computing device X2 acquires an actual voltage value of the battery BT mounted on the printer 1. Subsequently, the threshold value setting procedure S30 (corresponding to the first threshold value setting procedure) is executed. In the threshold value setting procedure S30, the computing device X2 variably sets a threshold value according to the actual voltage value acquired in the voltage acquisition procedure S20. Various forms are conceivable for a method of setting the threshold value and, for example, the threshold value can be set relatively high when the actual voltage value is relatively high (in the case that the remaining charge amount of the battery BT is sufficient), and the threshold value can be set relatively low when the actual voltage value is relatively low (in the case that the remaining charge amount of the battery BT is small). The process then goes to the line specification procedure S40.

In the line specification procedure S40, the computing device X2 determines whether or not an on-dot ratio represented by the number of on-dots/(the number of on-dots+the number of off-dots), or the number of on-dots, is equal to or greater than the threshold value set in the threshold value setting procedure S30 for each print line in the binarized dot pattern generated in the dot pattern generation procedure S10, and specifies a print line equal to or greater than the threshold value. This threshold value represents an allowable value of the number of on-dots or a ratio thereof (collectively referred to as a "black ratio") in the print line), is therefore also referred to as a black ratio allowable value, and is set to, for example, 70% according to an actual voltage value in this example. The process of the line specification procedure S40 will be described in more detail with reference to FIG. 10. In FIG. 10, the up-down direction corresponds to the feeding direction and the left-right direction corresponds to the raster direction. Therefore, each print line has 25 dots of the X coordinates 0 to 24. The print line of the Y coordinate 9 has 25 on-dots out of the 25 dots so that the on-dot ratio is 100%, and the print line of the Y coordinate 21 has 18 on-dots out of the 25 dots so that the on-dot ratio is 72%. Therefore, the print lines of the Y coordinates 9, 21 are specified as lines equal to or greater than the threshold value in the line specification procedure S40. Similarly, in FIG. 10, the Y coordinates 19, 22, 23 are specified as lines equal to or greater than the threshold value, in addition to the Y coordinates 9, 21. By executing the line specification procedure S40 in this way, as shown in FIG. 9B, the print lines having the black ratio equal to or greater than the threshold value are specified in the print data shown in FIG. 9A. After the execution of the line specification procedure S40, the labeling procedure S50 is executed.

In the labeling procedure S50, the computing device X2 separately identifies multiple dot groups such that the on-dots adjacent to each other form one dot group in the binarized dot pattern generated in the dot pattern generation procedure S10. FIG. 10 shows a binarized dot pattern in the case that the multiple dot groups are separately identified in the labeling procedure S50. In FIG. 10, the binarized dot pattern has 13 separately identified dot groups of alphabets a-m. For example, referring to the alphabet b, in the set of (X coordinate, Y coordinate), the dot (8, 3) are mutually adjacent to the dots (9, 3), (8, 4) shifted by one dot in the raster direction or the transport direction. The dots (8, 3) are also mutually adjacent to the dot (9, 4) shifted by one dot in the diagonal direction of 45 degrees. Therefore, these dots are identified as the same dot group and indicated by the same label b. The dots (9, 5), (10, 6), and (11, 7) are also included in the dot group of the label b. Similarly, in the example of FIG. 10, the 13 dot groups of alphabets a-m are separately identified. After execution of the labeling procedure S50, the dot group specification procedure S60 is executed.

In the dot group specification procedure S60, the computing device X2 specifies a first dot group including the print line specified in the line specification procedure S40 out of the multiple dot groups (also referred to as isolated dot groups) identified in the labeling procedure S50. A dot group other than the first dot group is referred to as a second dot group. In the example of FIG. 10, in the line specification procedure S40, the Y coordinates 9, 19, 21, 22, 23 have been specified as lines equal to or greater than the threshold value. Therefore, in this dot group specification procedure S60, the dot groups d, e, g, h, i, j, k, l, m including the Y coordinates 9, 19, 21, 22, 23 are specified as the first dot groups in the multiple dot groups a-m. Therefore, as shown in FIG. 9C, gray portions are specified as the first dot groups in the print data with the specified print lines shown in FIG. 9B. After execution of the dot group specification procedure S60, the density reduction processing procedure S70 is executed.

In the density reduction processing procedure S70, the computing device X2 executes a predetermined density reduction process of making the density at the time of print formation of the on-dots included in the first dot group (the dot group shown in gray in FIG. 10) specified in the dot group specification procedure S60 lower than the density at the time of print formation of said on-dots included in the second dot group (the dot group shown in black in FIG. 10) other than the first dot group.

Various methods are used for the predetermined density reduction processing procedure S70. In this embodiment, for example, a masking process of thinning on-dots at a predetermined thinning rate is executed as the density reduction processing procedure S70. FIGS. 11A and 11B show an example of a masking process reducing a density of a binary image by half with a 50% mask. For example, description will be made of the case that a binarized dot pattern (character "F") shown in FIG. 11A is specified as the first dot group by the series of processes. In this case, in the density reduction processing procedure S70, a mask shown in FIG. 11B is used. For masking, a mask with the thinning rate of 50% is shown in FIG. 11B. In the density reduction processing procedure S70, the computing device X2 executes an AND operation between the on-dots of the binarized dot pattern of FIG. 11A and the on-dots of the mask of FIG. 11B to generate a binarized dot pattern as shown in FIG. 11C. Such a process is also referred to as a dither process. Although the binarized dot pattern after the dither process has the density reduced by half, an image having a resolution of 300 dpi etc. is actually formed, so that the pattern visually appears gray. The process executed in the density reduction processing procedure S70 is not limited to this example, and various methods are usable.

By executing this density reduction processing procedure S70, the print data of FIG. 9A is subjected to the density reduction process as shown in FIG. 9C in the dot group including a print line having a high black ratio. For example, description will be made of the case that the print data is print data for forming a frame line and an object (characters A, B, C, D, E, F) arranged within the frame line as shown in FIG. 12A. In this case, in the dot pattern generation procedure S10, a binarized dot pattern corresponding to the print data is generated; in the dot group specification procedure S60, the first dot group constituting the frame line is specified; and in the density reduction processing procedure S70, the density reduction process is executed for the on-dots included in the first dot group constituting the frame line. Therefore, as shown in FIG. 12B, the density reduction process is executed only for the frame line specified as the first dot group in the print data, and the density reduction process is not executed for the object corresponding to the second dot group (characters A, B, C, D, E, F).

After the execution of the density reduction processing procedure S70, the print data subjected to the series of processes is transmitted to the printer 1, and the normal printing process is executed by the printer 1. In this case, the instantaneous maximum power consumption can be reduced in the printer 1 since the print lines having a high black ratio are subjected to the density reduction process, and therefore, it is not necessary to reduce the feeding speed for suppression of the instantaneous maximum power consumption, so that the feeding and printing can be performed at a normal speed.

Summary of Embodiment of the Present Disclosure

The printing processing program according to the embodiment of the present disclosure has been described. As described above, in the embodiment, a print based on print data is performed on the fed roll sheet 3A by the thermal line head 32 arranged in the orthogonal direction orthogonal to the transport direction. Specifically, the heat generation elements are not energized by the print-head driving circuit 205 at off-dots, while the heat generation elements are energized by the print-head driving circuit 205 at on-dots, in the dot pattern corresponding to the print data, so that dots are formed for each print line of the roll sheet 3A. As a result, a printed matter (a print label in this example) is completed (alternatively, the printed matter may be an uncut print tape).

In the embodiment of the present disclosure, when the printing processing program is executed by the computing device X2, the dot pattern generation procedure S10, the line specification procedure S40, the labeling procedure S50, the dot group specification procedure S60, and the density reduction processing procedure S70 are executed.

Specifically, when the binarized dot pattern corresponding to the print data is generated in the dot pattern generation procedure S10, the on-dot ratio (or the number of on-dots) is calculated for each print line in the binarized dot pattern, and a specific print line having the on-dot ratio (or the number of on-dots) equal to or greater than the predetermined threshold value (a print line having a large print load for the printer and requiring a reduction in print speed if left as it is, as described above) is specified in the line specification procedure S40.

On the other hand, in the labeling procedure S50, a process (labeling) is performed to separately identify on-dots adjacent to each other as one dot group in the binarized dot pattern. Out of the identified dot groups, dot groups (the first dot groups) including the specific print lines are specified in the dot group specification procedure S60. As a result, the first dot groups at least partially including the print lines having a large print load specified as described above are specified.

The predetermined density reduction process is then performed in the subsequent density reduction processing procedure S70 to perform control such that the density at the time of print formation of the specified first dot groups becomes lower than the second dot groups other than the first dot groups.

Particularly in this embodiment, the computing device X2 executes the voltage acquisition procedure S20 for acquiring an actual voltage value of the battery BT mounted on the printer 1, and the first threshold value setting procedure S30 for variably setting the threshold value according to the actual voltage value acquired in the voltage acquisition procedure S20.

Particularly in this embodiment, as described above with reference to FIG. 12, the computing device X2 can generate the binarized dot pattern corresponding to the print data for forming a frame line and an object arranged within the frame line in the dot pattern generation procedure S10, specify the first dot group constituting the frame line in the dot group specification procedure S60, and execute the density reduction process for the on-dots included in the first dot group constituting the frame line in the density reduction processing procedure S70.

Particularly in this embodiment, the computing device X2 executes a masking process of thinning on-dots at a predetermined thinning rate as the density reduction process in the density reduction processing procedure S70.

The embodiment of the present disclosure has been described in detail with reference to the accompanying drawings. However, it is needless to say the scope of the technical ideas of the present disclosure is not limited to the embodiment described above. Obviously, those having ordinary knowledge in the technical field of the present disclosure can conceive various changes, modifications, combinations, etc. made within the scope of the technical ideas of the present disclosure described in the claims. Therefore, techniques after these changes, modifications, combinations, etc. naturally fall within the scope of the technical ideas of the present disclosure.

<Printing Process of Printing Processing Program According to First Modification Example of Embodiment of the Present Disclosure>

For example, in the series of procedures executed by the computing device X2 according to the printing processing program in the embodiment, the density reduction process is executed in the density reduction processing procedure S70 only for the first dot groups specified in the dot group specification procedure S60. However, for example, the density reduction process can also be executed for the second dot group surrounded by any of the first dot groups in the density reduction processing procedure S70.

Specifically, for example, in the case of the binarized dot pattern shown in FIG. 10, the dot group f is the second dot group, not the first dot group, and is therefore not subjected to the density reduction process in the embodiment. However, in the case that the dot group e and the dot group f represent a character, a figure, or a symbol, if the dot group e specified as the first dot group is subjected to the density reduction process while the dot group f is not subjected to the density reduction process, this may give a feeling of strangeness to a viewer. Therefore, according to a first modification example, as described above, the density reduction process is also executed for the second dot group surrounded by the first dot group at step S70. Therefore, in the case of the binarized dot pattern shown in FIG. 10, the density reduction process is also executed for the dot group f surrounded by the dot group e which is the first dot group.

<Printing Process of Printing Processing Program According to Second Modification Example of Embodiment of the Present Disclosure>

For example, in the description of the embodiment, the battery voltage acquisition procedure S20 and the threshold value setting procedure S30 are executed in the series of procedures executed by the computing device X2 according to the printing processing program. However, the threshold value may be uniformly set as a fixed value. In this case, the battery voltage acquisition procedure S20 and the threshold value setting procedure S30 may not be executed. In another modification example, as shown in FIG. 13, a model acquisition procedure S120 and a threshold value setting procedure S130 may be executed instead of the processes of the battery voltage acquisition procedure S20 and the threshold value setting procedure S30. FIG. 13 is a flowchart showing the printing process of the printing processing program according to the second modification example of the embodiment of the present disclosure.

In this case, in the model acquisition procedure S120, the computing device X2 acquires model information of the printer 1. In the threshold value setting procedure S130 (corresponding to the second threshold value setting procedure), the computing device X2 variably sets the threshold value according to the model information acquired in the model acquisition procedure S120.

It is noted that terms "vertical", "parallel", "plane", etc. in the above description are not used in the exact meanings thereof. Specifically, these terms "vertical", "parallel", "plane", etc. allow tolerances and errors in design and manufacturing and have meanings of "substantially vertical", "substantially parallel", and "substantially plane", etc.

It is noted that terms "same", "equal", "different", etc. in relation to a dimension and a size of the appearance in the above description are not used in the exact meaning thereof. Specifically, these terms "same", "equal", and "different" allow tolerances and errors in design and manufacturing and have meanings of "substantially the same", "substantially equal", and "substantially different".

However, when a value used as a predefined determination criterion or a delimiting value is described such as a threshold value and a reference value, the terms "same", "equal", "different", etc. used for such a description are different from the above definition and have the exact meanings.

The arrows shown in the figures such as FIG. 4 indicate an example of a signal flow and are not intended to limit the signal flow directions.

The flowcharts shown in FIGS. 8 and 13 are not intended to limit the present disclosure to the procedures shown in the flows, and the procedures may be added/deleted or may be executed in different order without departing from the spirit and the technical ideas of the disclosure.

The techniques of the embodiment and modification examples may appropriately be utilized in combination other than those described above.

Although not exemplarily illustrated one by one, the present disclosure is implemented with various modifications applied without departing from the spirit thereof.

What is claimed is:

1. A non-transitory computer-readable medium storing a printing processing program for executing steps on a computing device, said computing device included in an operating terminal for operating a printer comprising a thermal line head that includes a plurality of heat generation elements and is configured to form dots on respective print lines divided by print resolution on a fed print-receiving medium, and an energizing device configured to selectively control drive of said plurality of heat generation elements according to print data, said steps comprising:

a dot pattern generation step for generating a binarized dot pattern including on-dots to be printed and off dots not to be printed corresponding to said print data;

a line specification step for determining whether or not an on-dot ratio represented by the number of on-dots/(the number of on-dots+the number of off-dots), or the number of on-dots, is equal to or greater than a threshold value for each print line in said binarized dot pattern generated in said dot pattern generation step, and for specifying at least one print lines equal to or greater than said threshold value;

a labeling step for separately identifying a plurality of dot groups such that the on-dots adjacent to each other form one dot group in said binarized dot pattern generated in said dot pattern generation step;

a dot group specification step for specifying at least one first dot groups including said at least one print lines specified in said line specification step among the plurality of groups identified in said labeling step; and a density reduction process step for executing a predetermined density reduction process of making a density at the time of print formation of said on-dots included in said first dot groups specified in said dot group specification step lower than a density at the time of print formation of said on-dots included in at least one second dot groups other than the first dot groups.

2. The medium according to claim 1, wherein said steps further comprises:

a voltage acquisition step for acquiring an actual voltage value of a battery mounted on said printer, and a first threshold value setting step for variably setting said threshold value according to said actual voltage value acquired in said voltage obtaining step.

3. The medium according to claim 1, wherein said steps further comprises:

a model acquisition step for acquiring model information of said printer, and a second threshold value setting step for variably setting said threshold value according to said model information acquired in said model acquisition step.

4. The medium according to claim 1, wherein in said density reduction process step, said density reduction process is also executed for said second dot group surrounded by any of said first dot groups.

5. The medium according to claim 1, wherein in said dot pattern generation step, said binarized dot pattern corresponding to said print data for forming a frame line and an object arranged within said frame line is generated, wherein in said dot group specification step, said first dot group constituting said frame line is specified, and wherein in said density reduction process step, said density reduction process is executed for said on-dots included in said first dot group constituting said frame line.

6. The medium according to claim 1, wherein in said density reduction process step, a masking process of thinning on-dots at a predetermined thinning rate is executed.

7. The medium according to claim 1, wherein said printer further comprises:

a feeder configured to feed said print-receiving medium; and a driving device configured to drive said feeder; wherein said energizing device and said driving device are configured to drive said heat generation elements and said feeder by electric power supplied from said battery.

* * * * *